US011233359B2

(12) United States Patent
Wang et al.

(10) Patent No.: US 11,233,359 B2
(45) Date of Patent: Jan. 25, 2022

(54) ELECTRICAL CONNECTOR

(71) Applicant: Dongguan Luxshare Technologies Co., Ltd, Dongguan (CN)

(72) Inventors: KaiDe Wang, Dongguan (CN); ZhenXing Zheng, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 16/923,874

(22) Filed: Jul. 8, 2020

(65) Prior Publication Data

US 2021/0265782 A1 Aug. 26, 2021

(30) Foreign Application Priority Data

Feb. 24, 2020 (CN) ..... 202020201378.9

(51) Int. Cl.
*H01R 12/62* (2011.01)
*H01R 13/6471* (2011.01)
(Continued)

(52) U.S. Cl.
CPC ..... *H01R 13/6471* (2013.01); *H01R 12/62* (2013.01); *H01R 12/771* (2013.01);
(Continued)

(58) Field of Classification Search
CPC ..... H01R 12/721; H01R 12/716; H01R 2107/00; H01R 12/724; H01R 12/79; H01R 13/665; H01R 12/73; H01R 12/75; H01R 13/502; H01R 13/6581; H01R 13/6594; H01R 12/57; H01R 12/62; H01R 13/405; H01R 13/6471; H01R 24/64; H01R 43/205; H01R 12/52; H01R 12/737; H01R 13/04; H01R 13/514; H01R 13/6275;
(Continued)

(56) References Cited

U.S. PATENT DOCUMENTS 7,267,575 B1 * 9/2007 Hwang ..... H01R 13/6593 439/497
7,857,650 B1 * 12/2010 Wu ..... H01R 13/6275 439/352
(Continued)

FOREIGN PATENT DOCUMENTS

CN 203574938 U 4/2014
CN 207677189 U 7/2018
(Continued)

*Primary Examiner* — Truc T Nguyen
(74) *Attorney, Agent, or Firm* — Birch, Stewart, Kolasch & Birch, LLP

(57) ABSTRACT

The present disclosure disclosed an electrical connector comprising a substrate and a housing. The substrate comprises a plugging part and a connecting part. A plurality of signal terminals and a plurality of ground terminals are disposed on at least one surface of the plugging part. A difference in length exists between an edge of each of the plurality of signal terminals away from the connecting part and an edge of each of the plurality of ground terminals away from the connecting part. The difference in length is 0.3 to 0.5 mm. The housing covers the connecting part, comprising a top cover covering a surface of the substrate comprising the plugging part.

14 Claims, 6 Drawing Sheets

(51) Int. Cl.
*H01R 13/502* (2006.01)
*H01R 13/627* (2006.01)
*H01R 13/639* (2006.01)
*H01R 12/77* (2011.01)

(52) U.S. Cl.
CPC ..... *H01R 13/502* (2013.01); *H01R 13/6271* (2013.01); *H01R 13/639* (2013.01)

(58) Field of Classification Search
CPC ..... H01R 13/6587; H01R 13/6658; H01R 2103/00; H01R 24/50; H01R 43/24; H01R 12/53; H01R 12/58; H01R 12/7082; H01R 12/7088; H01R 12/714; H01R 12/722; H01R 12/727; H01R 12/77; H01R 12/78; H01R 12/88; H01R 13/112; H01R 13/20; H01R 13/40; H01R 13/5045; H01R 13/506; H01R 13/629; H01R 13/62966; H01R 13/62988; H01R 13/631; H01R 13/6474; H01R 13/652; H01R 13/6582; H01R 13/6585; H01R 13/6591; H01R 13/6599; H01R 13/7032; H01R 24/28; H01R 43/00; H01R 43/26; H01R 12/523; H01R 12/585; H01R 12/7005; H01R 12/7023; H01R 12/7029; H01R 12/7052; H01R 12/7058; H01R 12/707; H01R 12/72; H01R 12/732; H01R 12/775; H01R 12/778; H01R 13/03; H01R 13/10; H01R 13/111; H01R 13/113; H01R 13/187; H01R 13/193; H01R 13/24; H01R 13/2407; H01R 13/2457; H01R 13/26; H01R 13/4223; H01R 13/432; H01R 13/436; H01R 13/4367; H01R 13/4368; H01R 13/46; H01R 13/504; H01R 13/512; H01R 13/5202; H01R 13/5213; H01R 13/5219; H01R 13/53; H01R 13/58; H01R 13/6205; H01R 13/6272; H01R 13/62927; H01R 13/62933; H01R 13/62983; H01R 13/64; H01R 13/641; H01R 13/642; H01R 13/646; H01R 13/6464; H01R 13/6477; H01R 13/648; H01R 13/6583; H01R 13/6588; H01R 13/659; H01R 13/6592; H01R 13/6595; H01R 13/6596; H01R 13/6608; H01R 13/6683; H01R 13/6691; H01R 13/7031; H01R 13/7175; H01R 13/7177; H01R 13/719; H01R 2101/00; H01R 2201/04; H01R 2201/06; H01R 2201/20; H01R 2201/26; H01R 24/00; H01R 24/20; H01R 24/38; H01R 24/40; H01R 24/42; H01R 24/54; H01R 24/542; H01R 24/58; H01R 24/60; H01R 24/62; H01R 24/76; H01R 27/02; H01R 31/06; H01R 31/065; H01R 33/02; H01R 39/64; H01R 43/005; H01R 43/16; H01R 43/18; H01R 43/20; H01R 4/02; H01R 4/2416; H01R 4/46; H01R 4/4818; H01R 9/0515; H01R 9/0518; H01R 9/11; H01R 9/16; H01R 9/2416; H01R 9/2658
See application file for complete search history.

(56) References Cited

U.S. PATENT DOCUMENTS

| | | | | |
|---|---|---|---|---|
| 9,728,876 | B1 * | 8/2017 | Shiue | H01R 12/7064 |
| 10,096,944 | B2 * | 10/2018 | Huang | H01R 13/6582 |
| 2011/0212643 | A1 * | 9/2011 | Reed | H01R 13/508 439/345 |
| 2017/0324188 | A1 * | 11/2017 | Guo | H01R 13/5202 |
| 2018/0205180 | A1 * | 7/2018 | Zhao | H01R 43/24 |
| 2019/0296466 | A1 * | 9/2019 | Lappoehn | H05K 3/325 |
| 2020/0144752 | A1 * | 5/2020 | Liao | H01R 12/774 |
| 2020/0266584 | A1 * | 8/2020 | Lu | H01R 12/79 |
| 2020/0403330 | A1 * | 12/2020 | Liao | H01R 12/57 |

FOREIGN PATENT DOCUMENTS

| | | | |
|---|---|---|---|
| CN | 208209042 | U | 12/2018 |
| CN | 209266665 | U | 8/2019 |

* cited by examiner

ELECTRICAL CONNECTOR

CROSS REFERENCE TO RELATED APPLICATION

This application claims the priority benefit of Chinese Patent Application Serial Number CN202020201378.9, filed on Feb. 24, 2020, the full disclosure of which is incorporated herein by reference.

BACKGROUND

Technical Field

The present disclosure relates to the technical field of electrical connector, particularly an electrical connector.

Related Art

The conventional connector comprises components which are wire-to-board and board-to-board connectors. The wire-to-board connector has a substrate provided with multiple goldfingers. The multiple goldfingers are respectively signal and ground terminals of connectors. The transmission performance and size of connectors are affected by the distance between the goldfingers or the length of the goldfingers. The layout of goldfingers of the conventional connectors is prone to crosstalk.

SUMMARY

The embodiments of the present disclosure provide an electrical connector to solve the problems that current electrical connectors are prone to crosstalk between multiple goldfingers of conventional connectors.

The present disclosure provides an electrical connector comprising a substrate and a housing. The substrate comprises a plugging part and a connecting part. A plurality of signal terminals and a plurality of ground terminals are disposed on at least one surface of the plugging part. A difference in length exists between an edge of each of the plurality of signal terminals away from the connecting part and an edge of each of the plurality of ground terminals away from the connecting part. The difference in length is 0.3 to 0.5 mm. The housing covers the connecting part. The housing comprises a top cover covering a surface of the substrate comprising the plugging part.

In the embodiments of the present disclosure, by configuring a length difference to be 0.3 to 0.5 mm between the ground terminals and signal terminals of the plugging part, the crosstalk of a plurality of signal terminals of the plugging part and the size of the substrate are both effectively reduced. Meanwhile, the electrical connectors could also be downsized as the substrate is downsized.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
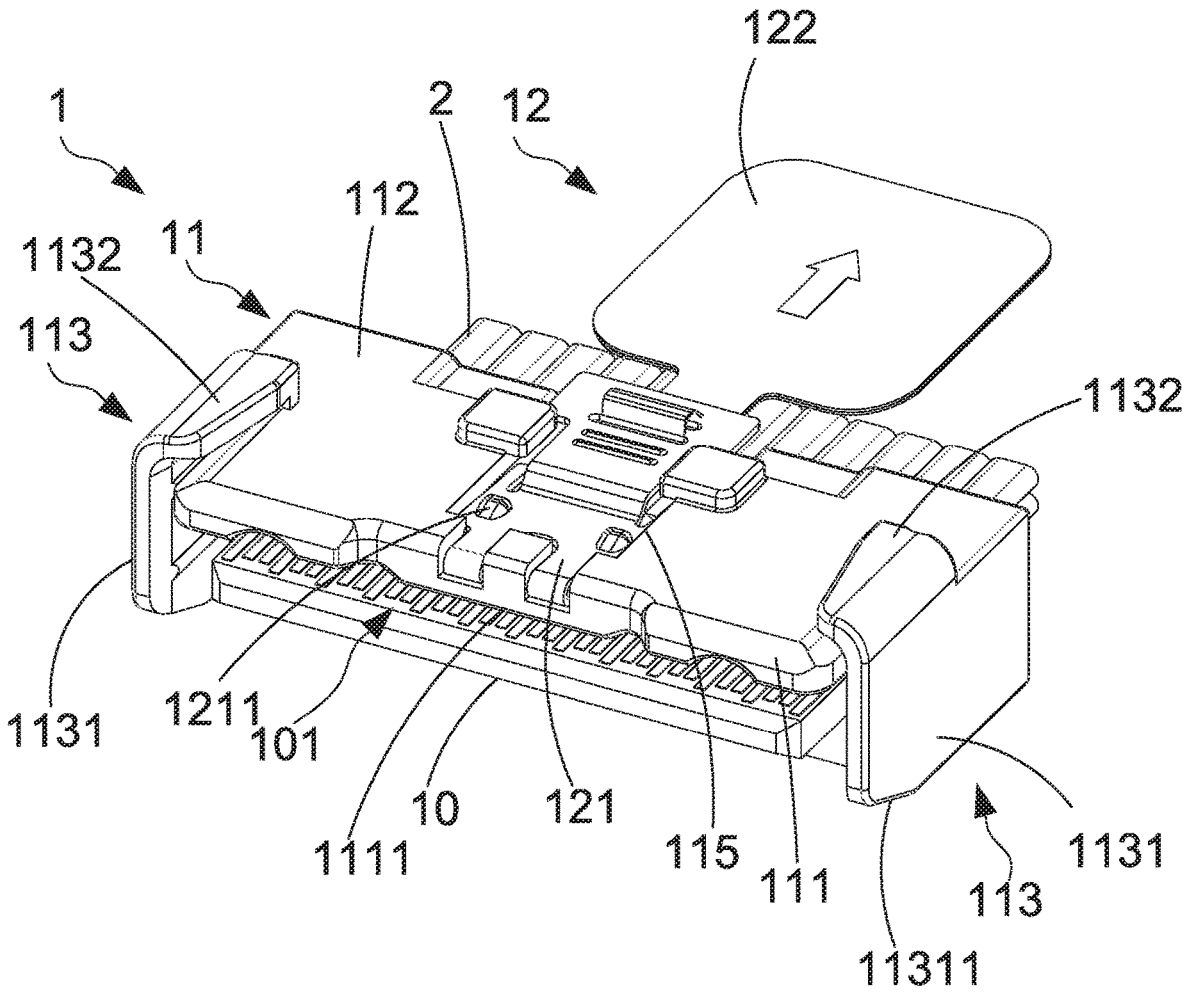
FIG. 1 is a perspective view of an electrical connector of one embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
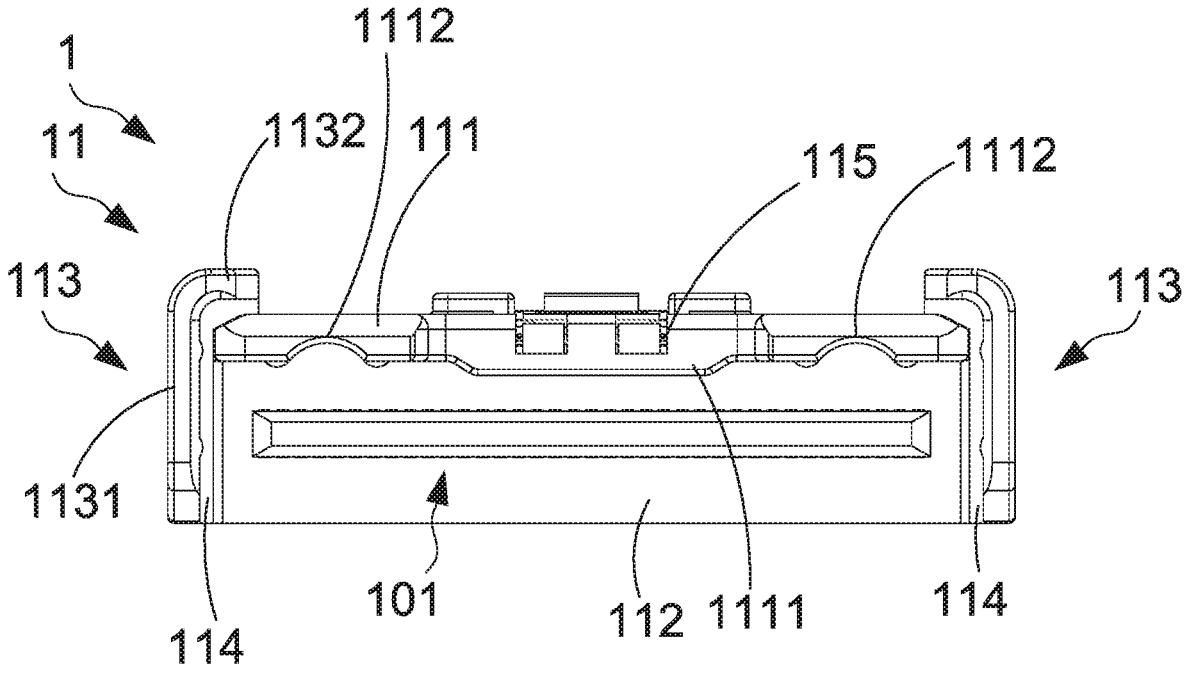
FIG. 2 is a front view of the electrical connector of one embodiment of the present disclosure.
Figure 3:
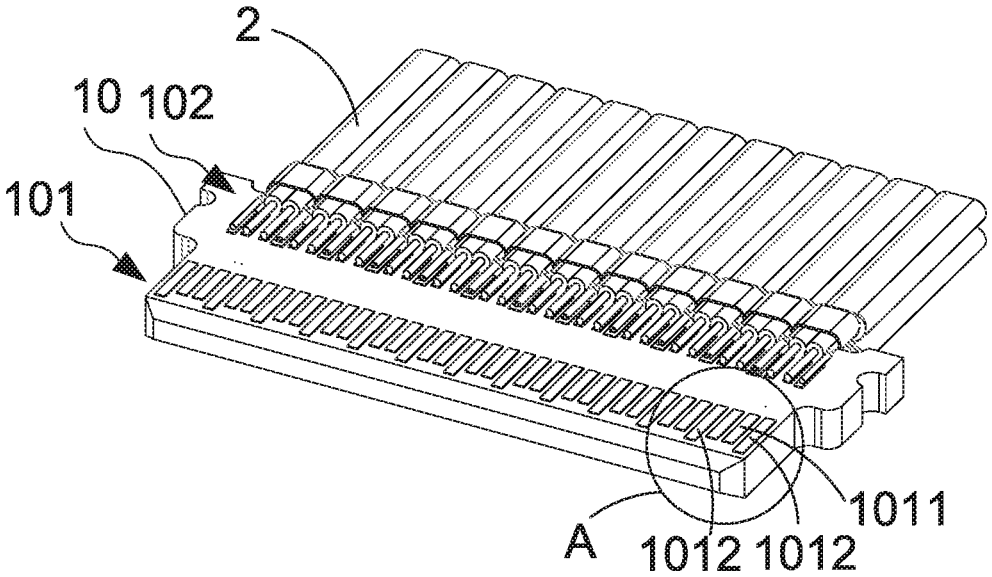
FIG. 3 is a schematic diagram of a substrate of one embodiment of the present disclosure.

FIG. 1 and FIG. 2 are perspective view and exploded view of an electrical connector of one embodiment of the present disclosure. FIG. 3 is a schematic diagram of a substrate of one embodiment of the present disclosure. As shown in the figures, the electrical connector 1 of this embodiment comprises a substrate 10 and a housing 11. The substrate 10 comprises a plugging part 101 and a connecting part 102. The plugging part 101 and the connecting part 102 are respectively disposed on a front end and a rear end of the substrate 10. The housing 11 covers the connecting part 102 and comprises a top cover 111. The top cover 111 extends toward the plugging part 101 and covers a surface of the plugging part 101 of the substrate 10. In this embodiment, the housing 11 comprises a body part 112 covering the connecting part 102. The plugging part 101 protrudes from the body part 112. The top cover 11 is disposed on one side of the body part 112 close to the plugging part 101.

A plurality of signal terminals 1011 and a plurality of ground terminals 1012 are disposed on at least one surface of the plugging part 101. A plurality of signal terminals 1011 and a plurality of ground terminals 1012 are disposed at intervals. In this embodiment, a pair of signal terminals 1011 is provided between two adjacent ground terminals 1012. A ground terminal 1012 is provided between two pairs of signal terminals 1011. More than one pair of signal terminals 1011 can also be provided between two adjacent ground terminals 1012. A plurality of signal terminals and a plurality of ground terminals are also disposed on at least one surface of the connecting part 102. The plurality of signal terminals and the plurality of ground terminals of the connecting part 102 correspond to the plurality of signal terminals 1011 and the plurality of ground terminals 1012 of the plugging part 101. The substrate 10 of this embodiment is a circuit board. The plurality of signal terminals 1011 and the plurality of ground terminals 1012 of the plugging part 101 and the plurality of signal terminals and the plurality of ground terminals of the connecting part 102 are goldfingers respectively. The plurality of signal terminals 1011 and the plurality of ground terminals 1012 of the plugging part 101 is electrically connected to the plurality of signal terminals and the plurality of ground terminals of the connecting part 102 through the circuit of the substrate 10. The connecting portion 102 of this embodiment is soldered to a plurality of cables 2.

Figure 4:
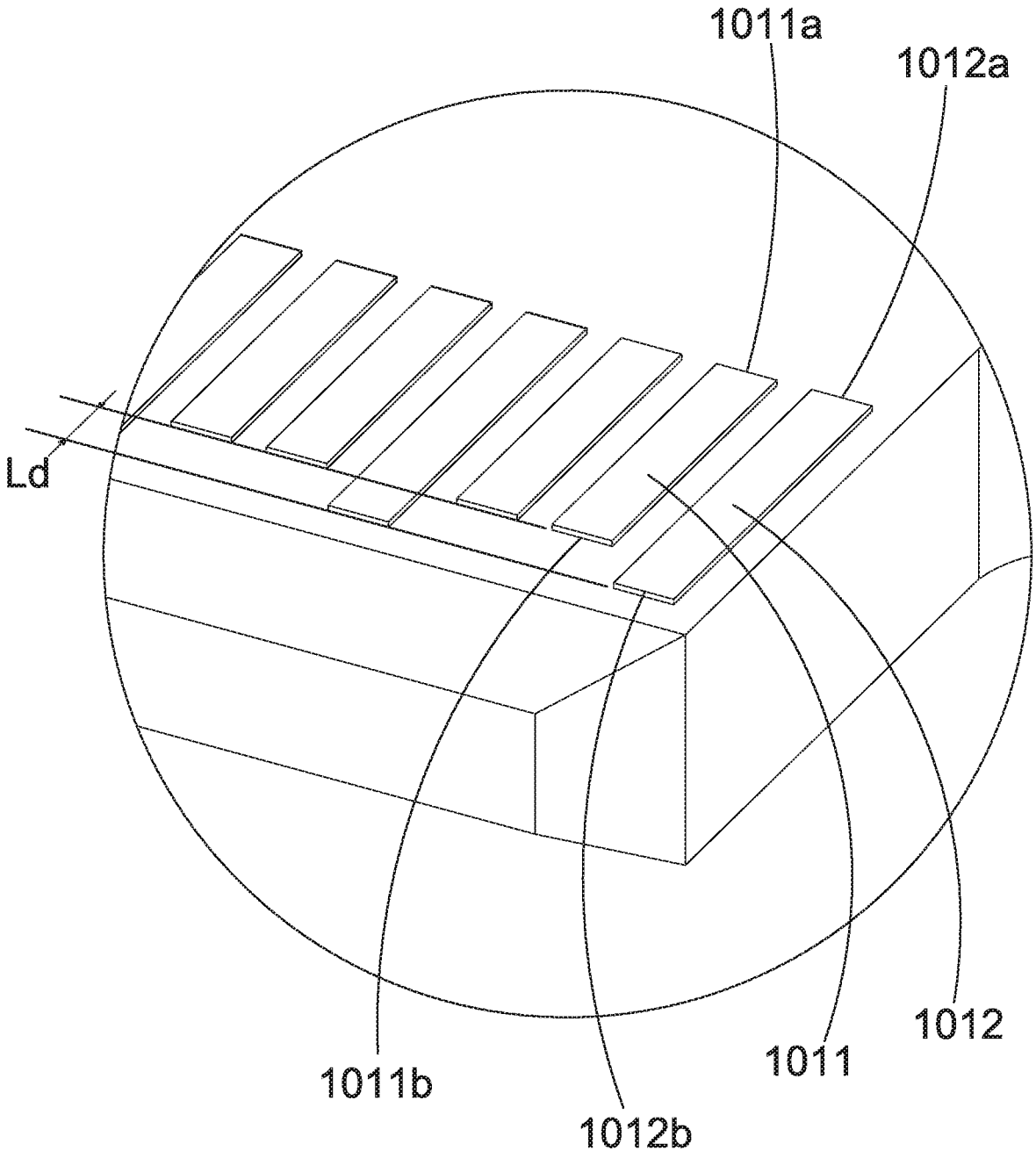
FIG. 4 is an enlarged view of the area A in FIG. 3.

FIG. 4 is an enlarged view of area A in FIG. 3. As shown in the figure, each of the plurality of signal terminals 1011 comprises a first signal edge 1011*a* and second signal edge 1011*b* opposite to the first signal edge 1011*a*. Each of the plurality of ground terminals 1012 comprises a first ground edge 1012*a* and a second ground edge 1012*b* opposite to the first ground edge 1012*a*. The length Ls between the first signal edge 1011*a* and the second signal edge 1011*b* of each of the plurality of signal terminals 1011 is less than the length Lg between the first ground edge 1012*a* and the second ground edge 1012*b* of each of the plurality of ground terminals 1012. The first signal edge 1011*a* of each of the plurality of signal terminals 1011 and the first ground edge 1012*a* of each of the plurality of ground terminals 1012 are close to the connecting part 102. The second signal edge 1011*b* of each of the plurality of signal terminals 1011 and the second ground edge 1012*b* of each of the plurality of ground terminals 1012 are away from the connecting part 102. The first signal edge 1011*a* of each of the plurality of signal terminals 1011 is aligned with the first ground edge 1012*a* of each of the plurality of ground terminals 1012. A length difference Ld exists between the second signal edge 1011*b* of each of the plurality of signal terminals 1011 and the second ground edge 1012*b* of each of the plurality of ground terminals 1012. The Ld is 0.3 to 0.5 mm, which means it is greater than or equal to 0.3 mm and less than or equal to 0.5 mm.

In one embodiment, the length difference Ld between the second signal edge 1011*b* of each of the plurality of signal terminals 1011 and the second ground edge 1012*b* of each of the plurality of ground terminals 1012 is 0.36 to 0.45 mm, which means the Ld is greater than or equal to 0.36 mm and less than or equal to 0.45 mm.

In one embodiment, the length difference Ld between the second signal edge 1011*b* of each of the plurality of signal terminals 1011 and the second ground edge 1012*b* of each of the plurality of ground terminals 1012 is 0.38 to 0.42 mm, which means the Ld is greater than or equal to 0.38 mm and less than or equal to 0.42 mm.

Therefore, the length of each of the plurality of ground terminals 1012 is greater than the length of each of the plurality of signal terminals 1011, so that crosstalk between the plurality of terminals can be avoided. Meanwhile, the length difference Ld between each of the plurality of signal terminals 1011 and each of the plurality of ground terminals 1012 is 0.3 to 0.5 mm, which downsizes the substrate 10 thereby further downsizing the electrical connector 1.

Figure 5:
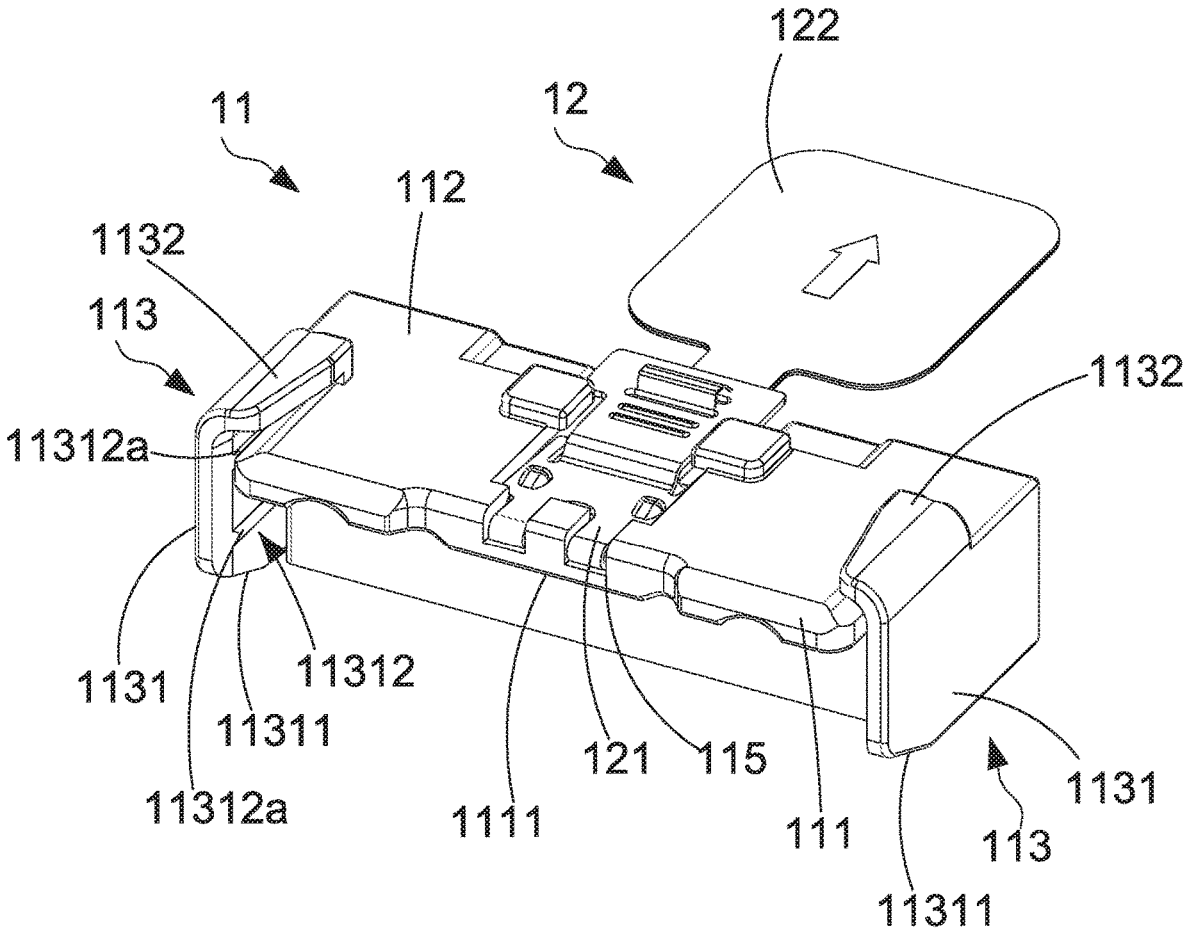
FIG. 5 is a perspective view of a housing of one embodiment of the present disclosure.
Figure 6:
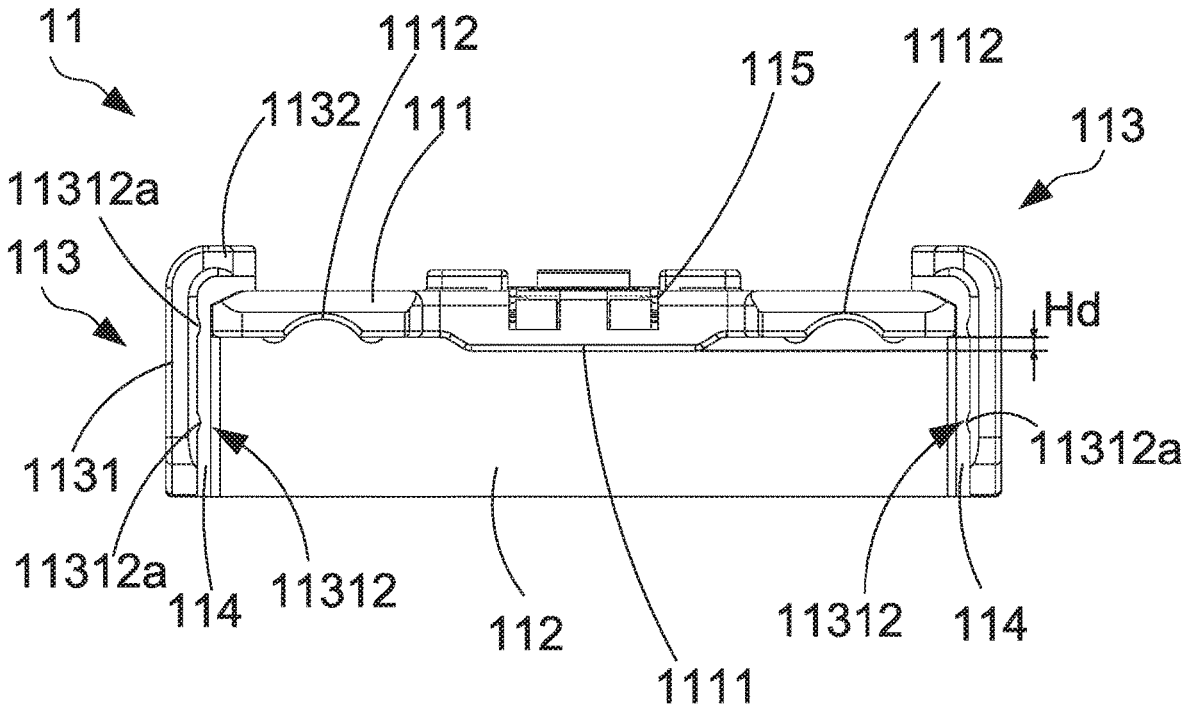
FIG. 6 is a front view of the housing of one embodiment of the present disclosure.

FIG. 5 and FIG. 6 are perspective view and front view of a housing of one embodiment of the present disclosure. In one embodiment, the housing 11 comprises a baffle component 113 disposed on the periphery of the body part 112. The baffle component 113 extends toward the plugging part 101 and is disposed around the plugging part 101. To insert the connector to be mated with the electrical connector 1 of this embodiment through the guiding of the baffle component 113. So that a housing of the mating connectors can be inserted between the baffle component 113 and the body part 112 or/and between the baffle component 113 and the top cover 111, and can cover the top cover 111. The baffle component 113 of this embodiment comprises two side baffles 1131 disposed at two opposite sides of the body part 112. The two side baffles 1131 extend toward the plugging part 101 and is disposed on two sides of the plugging part 101. At least a part of the sidewall of the housing of the mating connector is guided by the side baffles 1131 to enter the space between the side baffles 1131 and the body part 112 or between the side baffles 1131 and the top cover 111.

In one embodiment, the baffle component 113 of this embodiment further comprises two upper baffles 1132 respectively disposed on an inner surface of the corresponding side baffles 1131. The two upper baffles 1132 are close to the top cover 111. Each upper baffle 1132 extends horizontally from the corresponding side baffle 1131 to the top cover 111. In this embodiment, each upper baffle 1132 could cover a part of the top cover 111 of the housing 11. The upper baffle 1132 is functionally the same as the side baffle 1131, which guides the top part of the housing of the mating connector into the space between the upper baffle 1132 and the top cover 111.

In one embodiment, a limiting groove 114 is provided between the baffle component 113 and the body part 112. That is, the limiting groove 114 is disposed between each side baffle 1131 and the body part 112 and between each upper baffle 1132 and the body part 112. When the connector to be mated is inserted into the electrical connector 1 of this embodiment, the housing of the connector to be mated enters along the baffle component 113. Finally, a part of the housing of the connector to bemated is inserted into the limiting groove 114, so that the connector to be mated is accurately inserted into the electrical connector 1 of this embodiment to prevent the mating connector from being inserted obliquely into the electrical connector 1 of this embodiment.

In one embodiment, one side of each side baffle 1131 away from the top cover 111 is provided with an inclined surface 11311. An angle is defined between the inclined surface 11311 and a horizontal plane of the bottom side of the sidewall 1131 away from of the top cover 111. The angle is smaller than 45 degrees. The electrical connector 1 of this embodiment is obliquely plugged into the mating connector through the inclined surface 11311 on one side of each side baffle 1131 away from the top cover 111 to increase the degree of freedom of oblique insertion.

In one embodiment, each side baffle 1131 comprises a positioning protrusion 11312 facing an inner surface of the substrate 10. The positioning protrusion 11312 in this embodiment comprises a plurality of positioning protrusion strips 11312*a*. The extension direction of each positioning protrusion strip 11312*a* is parallel to the length direction of the substrate 10. That is, each positioning protrusion strip 11312*a* extends from the body part 112 in a direction away from the body part 112. The protrusion strips 11312*a* can also be replaced with bumps. The housing of the mating connectors can be positioned at the horizontal position of the electrical connector 1 of this embodiment to prevent the housing of the mating connectors from a left-and-right shaking in the electrical connector 1 of this embodiment by the positioning protrusion 11312.

The electrical connector 1 of this embodiment further comprises a latch 12 disposed on an outer surface of the housing 11 comprising the top cover 111. A latch accommodating groove 115 is provided on the outer surface of the top cover 111 of the housing 11. The latch 12 is disposed in the latch accommodating groove 115. The latch 12 comprises a latch elastic sheet 121 and a puller 122. The latch elastic sheet 121 is disposed in the latch accommodating groove 115. The puller is disposed on one side of the latch elastic sheet 121 away from the plugging part 101. A surface of the latch elastic sheet 121 away from the top cover 111 comprises a latch part 1211. When the electrical connector 1 of this embodiment is inserted into the mating connector, the housing of the mating connector is covered on the top cover 111 and is connected to the latch part 1211 of the latch elastic sheet 121 to secure the electrical connector 1 of this embodiment to the mating connector.

In one embodiment, an inner surface of the top cover of the housing 11 is provided with a reinforcing part 1111 corresponding to the latch accommodating groove 115. The reinforcing part 1111 protrudes from an inner surface of the top cover 111 of the housing 11 toward an inner space of the housing 11. A height difference Hd exists between a surface of the reinforcing part 1111 facing the plugging part 101 and the inner surface of the top cover 111 of the housing 11. That is, the thickness of the bottom portion under the latch accommodating groove 115 is increased by the reinforcing part 1111, thereby increasing the structural strength of the latch accommodating groove 115.

In one embodiment, an anti-shrink groove 1112 is provided on an inner surface of the top cover 111. In this embodiment, the number of anti-shrink grooves 1112 is two. The two anti-shrink grooves 1112 are respectively disposed on two sides of the latch accommodating groove 115 to prevent the housing 11 from shrinking during manufacture, and thereby to avoid warping of the sides of the top cover 111.

In summary, the present disclosure proposed an electrical connector. As the length difference between the ground terminals and the signal terminals of the plugging part set to 0.3 to 0.5 mm, the crosstalk between the plurality of terminals of the plugging part can be reduced, and the substrate and electrical connector can also be downsized. The housing is provided with a baffle component guiding the electrical connector of the present disclosure into the mating connector. One side of the baffle component away from the top cover is provided with an inclined surface so that the electrical connector of the present disclosure can be obliquely inserted into the mating connector, and the degree of freedom of oblique insertion is increased. Positioning protrusions are provided on the inner surface of the baffle component. When the electrical connector of the present application is mating with a connector, the positioning protrusions can prevent the dicking connector from offsetting in the electrical connector of the present application, and reduce the friction between them, so that the mating connector can be connected to the electrical connector of the present application without obstruction.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a substrate comprising a plugging part and a connecting part, wherein a plurality of signal terminals and a plurality of ground terminals are disposed on at least one surface of the plugging part; a difference in length exists between an edge of each of the plurality of signal terminals away from the connecting part and an edge of each of the plurality of ground terminals away from the connecting part; the difference in length is 0.3 to 0.5 mm;

a housing covering the connecting part, wherein the housing comprises a top cover covering a surface of the plugging part of the substrate; and a latch provided on an outer surface of the housing, wherein a latch accommodating groove is provided on the outer surface of the housing, the latch is disposed in the latch accommodating groove, an inner surface of the housing is provided with a reinforcing part corresponding to the latch accommodating groove, and a difference in height exists between a surface of the reinforcing part facing the plugging part and the inner surface of the housing.

2. The electrical connector according to claim 1, wherein the housing comprises a baffle component disposed at the periphery of the plugging part.

3. The electrical connector according to claim 2, wherein the baffle component comprises two side baffles disposed at two sides of the plugging part.

4. The electrical connector according to claim 3, wherein one side of each of the side baffles away from the top cover is provided with an inclined surface.

5. The electrical connector according to claim 3, wherein a positioning protrusion is provided on an inner surface of each of the side baffles.

6. The electrical connector according to claim 3, wherein the baffle component further comprises two upper baffles; each of the upper baffles is disposed on an inner surface of each of the side baffles; each of the upper baffles horizontally extends toward the top cover from each of the side baffles.

7. The electrical connector according to claim 6, wherein each of the upper baffles covers a part of the top cover of the housing.

8. The electrical connector according to claim 2, wherein the housing comprises a body part; the plugging part is protruded from the body part; a limiting groove is provided between the baffle component and the body part.

9. The electrical connector according to claim 1, wherein the latch comprises a latch elastic sheet and a puller; the latch elastic sheet is disposed in the latch accommodating groove; the puller is disposed on one side of the latch elastic sheet away from the plugging part.

10. The electrical connector according to claim 1, wherein the substrate is a circuit board.

11. The electrical connector according to claim 10, wherein the plurality of signal terminals and the plurality of ground terminals are goldfingers, respectively.

12. The electrical connector according to claim 1, wherein an anti-shrink groove is provided on an inner surface of the top cover.

13. The electrical connector according to claim 1, wherein the connecting part is soldered to a plurality of cables.

14. The electrical connector according to claim 1, wherein the difference in length is 0.36 to 0.45 mm.

* * * * *